United States Patent [19]

Becker et al.

[11] Patent Number: 4,508,082

[45] Date of Patent: Apr. 2, 1985

[54] ELECTRONICALLY CONTROLLED FUEL METERING SYSTEM FOR AN INTERNAL COMBUSTION ENGINE

[75] Inventors: Wolfram Becker, Eberdingen; Helmut Denz, Stuttgart, both of Fed. Rep. of Germany

[73] Assignee: Robert Bosch GmbH, Stuttgart, Fed. Rep. of Germany

[21] Appl. No.: 602,622

[22] Filed: Mar. 6, 1984

Related U.S. Application Data

[63] Continuation of Ser. No. 326,089, Nov. 30, 1981, abandoned.

[30] Foreign Application Priority Data

Dec. 12, 1980 [DE] Fed. Rep. of Germany ..... 3046863

[51] Int. Cl.[3] ..... F02D 5/00

[52] U.S. Cl. ..... 123/478; 123/492

[58] Field of Search ..... 123/436, 478, 486, 487, 123/488, 492, 493

[56] References Cited

U.S. PATENT DOCUMENTS

| | | | |
|---|---|---|---|
| 4,112,879 | 9/1978 | Assenheimer et al. | 123/492 X |
| 4,214,306 | 7/1980 | Kobayashi | 123/492 X |
| 4,257,377 | 3/1981 | Kinugawa et al. | 123/492 |
| 4,355,614 | 10/1982 | Hayashi et al. | 123/436 |
| 4,364,363 | 12/1982 | Miyagi et al. | 123/492 |

*Primary Examiner*—Parshotam S. Lall
*Assistant Examiner*—W. R. Wolfe
*Attorney, Agent, or Firm*—Edwin E. Greigg

[57] ABSTRACT

An electronically controlled fuel metering system for an internal combustion engine is proposed which includes devices for damping engine jerking. The following signals are formed: ti (k) as the up-to-date load value; tiM as the up-to-date averaged load value; ti $(k-1)+\Delta ti/2$ as a special load value for use in a transition into overrunning; and $tiM+\Delta tiM/2$ for the purpose of successive approximation of the average value to up-to-date load values in the case of slow acceleration processes and flat courses of load reduction. A computer-controlled realization is possible for forming and selecting the individual values. A block circuit diagram is also provided for an electronically controlled fuel metering system made up of discrete modular elements.

8 Claims, 11 Drawing Figures

10
Ini, Z=1, ZS = ti (K)
Z1 = ti (K), Z2···ZN=0
A
11
Δti = ti(K) - ti(K-1)
12
Δti > Δti+
YES
ti new = ti (K)
14
NO
13
Δti < Δti-
YES
ti new = ti (K-1) + Δti/2
15
NO
= ti (k)
16
Z < N
YES
Z = N
17
ZS = ZS - ti (K-N)
18
Zj + 1 = Zj (j=1···N)
19
Z1 = ti (K)
20
ZS = ZS + ti (K)
21
tiM = ZS/Z
22
Δ tiM = ti(K) - tiM
23
ti > tiARN
YES
NO
27
Δ tiM > Δ ti3N
24
Δ tiM < Δ ti3
YES
NO
25
Δ tiM > Δ ti2
YES
NO
26
ti new = tiM + Δ tiM/2
28
ti new = tiM
30
Z = Z + 1
Z < N
ti(K-1) = ti new
ZS = ti new
Z = 1, Z2···ZN = 0
29
A
A
FROM 14
15
From 13
ti new
ti new = ti (k)
TO 29 a)

b)

| 1 | 2 | 3 | A | B | C | D |
|---|---|---|---|---|---|---|
| 0 | 1 | 1 | 1 | 0 | 0 | 0 |
| 0 | 1 | 0 | 0 | 1 | 0 | 0 |
| 1 | 1 | 0 | 0 | 0 | 0 | 1 |
| 0 | 0 | 0 | 0 | 0 | 1 | 0 |
| 45 | 41 | 42 | | | | |

ELECTRONICALLY CONTROLLED FUEL METERING SYSTEM FOR AN INTERNAL COMBUSTION ENGINE

This is a continuation of copending application Ser. No. 326,089, filed Nov. 30, 1981, now abandoned.

BACKGROUND OF THE INVENTION

The invention is based on an electronically controlled fuel metering system for an internal combustion engine having a metering signal generating circuit for forming a basic metering signal. Monitoring the individual metering signals and limiting variations in these metering signals are known as means for preventing abrupt changes in torque and thus to prevent "Jerking" of the engine. This is accomplished in the known system by establishing, on the basis of a specific metering signal, an upper and a lower threshold value for the next subsequent metering signal and having these threshold values then prevail in the case of overly large variations.

It has been found that this known "anti-jerking" system does not always function satisfactorily, because the means for limiting variations must be capable of being shut off during transitional states such as acceleration and overrunning, and imprecisions arise particularly upon the occurrence of these states.

OBJECT AND SUMMARY OF THE INVENTION

With the electronically controlled fuel metering system according to the invention the fuel metering is controlled according to four basic signals: engine present load, engine average load, engine overrun during slow load reduction, and an approximation of present engine load. An anti-jerking system is obtained which accomplishes good results in terms of driving smoothness and exhaust gas composition, even in critical operational states. It is advantageous in particular that different limitations are selected for different operational states, so that very exacting individual requirements may be taken into consideration.

It is an object of the present invention to compensate the fuel metering system for jerking of the internal combustion engine.

A second object is to compensate for jerking without enriching the fuel mixture.

A third object is to change the fuel metering signal duration in response to detected and calculated engine values to compensate for engine jerk.

The invention will be better understood and further objects and advantages thereof will become more apparent from the ensuing detailed description of preferred embodiments taken in conjunction with the drawings.

DESCRIPTION OF THE PREFERRED EMBODIMENT

The exemplary embodiment relates to an electrically controlled fuel metering system in an internal combustion engine with externally-supplied ignition, where the fuel is metered via injection valves controlled in a pulsed manner.

"Jerking" is a driving mode in which the vehicle is braked and then accelerated again in turn by cyclical fluctuations in torque. This is caused by the manner in which load is detected. The load signal ti is proportional to the air throughput in the intake tube and thus proportional to the output signal of the air flow rate meter and inversely proportional to the rpm. In the case of jerking, an approximately constant air flow rate signal may be assumed, while the rpm fluctuates around some average value. If the output voltage of the air flow rate meter remains constant, a reduction in rpm accordingly causes an enrichment of the mixture, while increasing rpm causes a leaning down of the mixture.

Now if a fuel metering system is designed in a $\lambda$ range in which the torque is proportional to the $\lambda$ value, then an increasing rpm causes the leaning down of the mixture and accordingly also causes a drop in torque—under some circumstances, a quite severe drop in torque—which in turn leads to an increased drop in rpm. This reduction in rpm causes an enrichment of the mixture, in accordance with the mathematical relationship of the load signal $ti \approx Q/n$, thus resulting in an increase in torque, which resembles an acceleration. The result of this, in turn, is an increase in rpm, and the entire process begins anew.

When coupled with an appropriate system capable of oscillating (engine—clutch—gear mechanism—Cardan shaft—rear axle—tires), this causes "jerking". This process can be brought on by a single, excessively high load signal ti, for instance, or by a dip in the road surface or the like, which triggers a rapid change in rpm.

In terms of such a system per se, capable of oscillating, various ranges, which are variously prone to jerking, exist in the family of load/rpm curves of an internal combustion engine.

Figure 1:
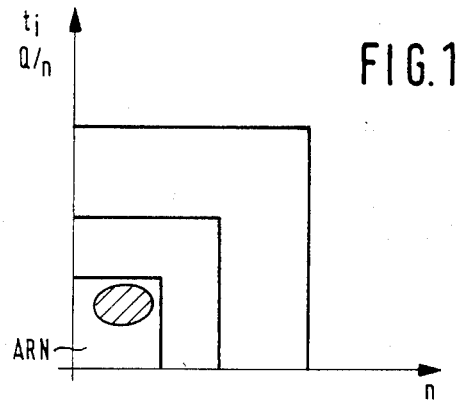
FIG. 1 is an rpm-load diagram showing a range particularly vulnerable to jerking.

Such a family of curves is illustrated in FIG. 1, including various ranges for various countermeasures as well as one particularly critical range in which jerking is critical because of the particular design of the engine and the vehicle.

Jerking can be damped by making the entire mixture richer. However, since economical fuel consumption and good exhaust-gas quality are desired goals, this method is not universally applicable. In contrast to this, in the subject of the realized embodiment an averaging of the individual metering signals is preferably performed in the range which is prone to jerking; specialized regulation is attained in transitional ranges.

Figure 2:
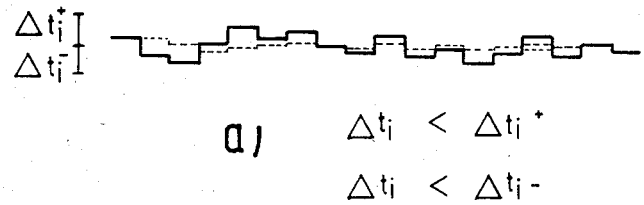
FIGS. 2*a–e* gives various examples for the mode of operation of the system at different operating conditions.

FIG. 2 shows various diagrams on the mode of operation of the exemplary embodiment at various operational states. FIG. 2*a* shows a very unsteady load signal (ti), whose individual values are averaged so as to equalize them.

FIG. 2*b* shows the signal course during a typical acceleration process; that is, the load signal increases sharply and exceeds certain threshold variation values. FIG. 2*c* shows the relationships which exists when there is a slow increase in load. There, the averaging is effective at the outset because of the fact that a specific value for variation in the load signal has not yet been attained. This averaging process would eventually cause a stronger and stronger mutual cancellation effect between the actual value and the averaged value, so that care must be taken in approximating these two different values.

FIGS. 2*d* and 2*e*, in corresponding fashion, illustrate conditions during a transition into overrunning and during a slow reduction in load.

What is essential is that the individual driving states are recognized and appropriately evaluated, and finally that the correct conclusions are drawn for providing a means of counteracting jerking.

Figures 3, 3A:
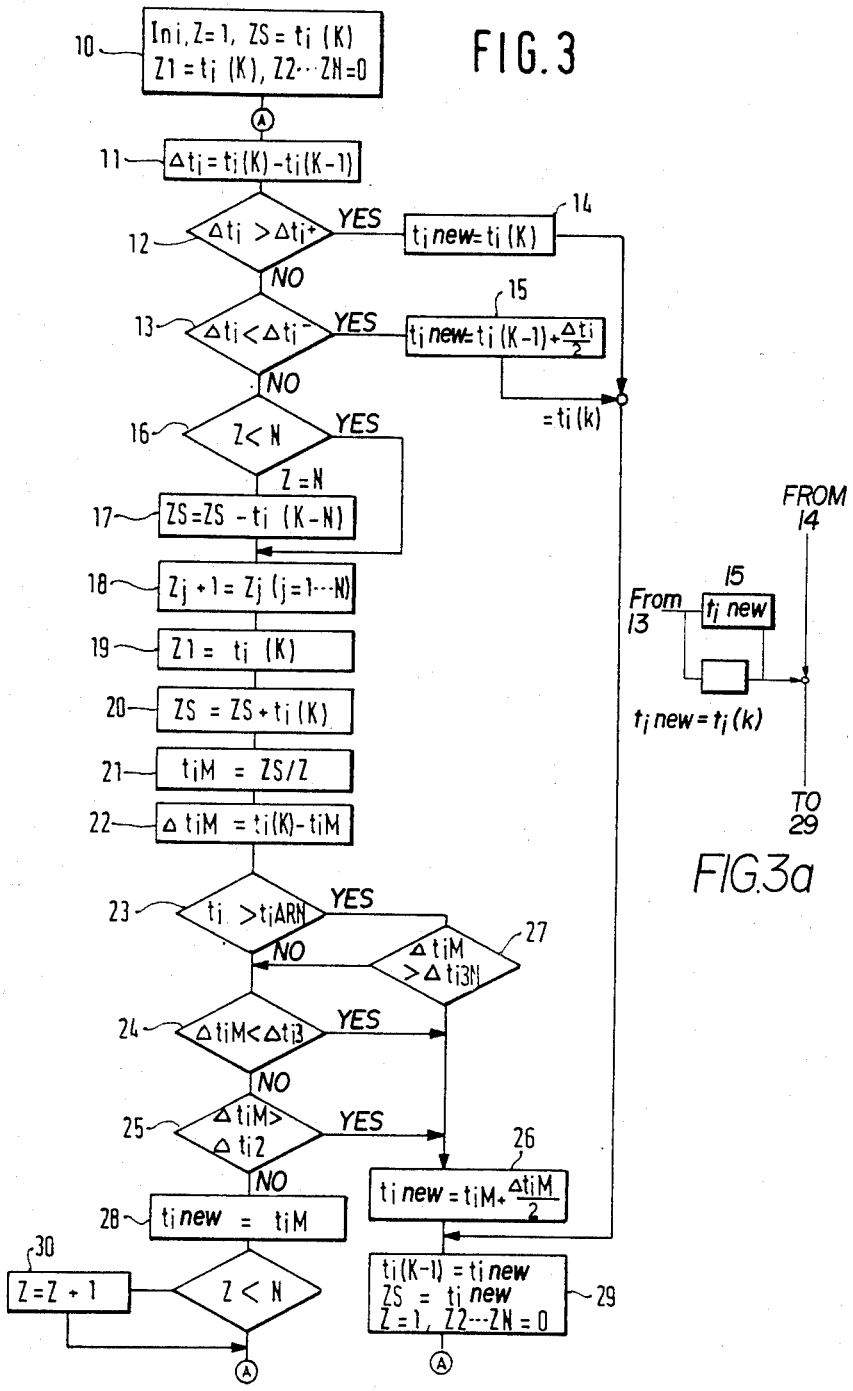
FIG. 3 is a flow diagram in connection with a computer-controlled realization of the invention.
FIG. 3*a* is an alternate embodiment of FIG. 3.

Since fuel metering systems having computer control are being used more and more frequently, FIG. 3 shows a flow diagram for a computer-controlled means of attaining the fuel metering system according to the invention.

In the flow diagram of FIG. 3, at the outset in block 10, individual ranges are placed in original status, counter states are reset, memory contents are cancelled and so forth. Subsequently, in block 11, a differentiation of sequential load signals is performed, which in turn is followed by a two fold interrogation in blocks 12 and 13. The interrogation in block 12 serves to recognize acceleration; if acceleration is ascertained, then the most recent value is adapted as a new load value (block 14) and is then forwarded and processed appropriately.

The second interrogation in block 13 relates to the recognition of overrunning. If a transition into overrunning is occurring, then either this most recent value is switched through the system, or, for the sake of a smooth transition, an adapted new value is selected in accordance with the formula $$ti_{new}=ti(k-1)+\Delta ti/2$$

This alternative possibility is indicated in 3*a*.

In the present exemplary embodiment, the averaging is effected using, at a maximum, the eight most recent values for load. The averaging is performed on the basis of the values stored in a shift register; in steady operation of the engine, the shift register is exposed in turn to the most recent value as it occurs, while the oldest value is erased in a so-called "shift-through" mode. The control of the shifting operation is the task of a counter for fixing the ranking sequence of the individual memory values. In the flow diagram of FIG. 3, 16 indicates an interrogation as to the maximum counter state and 17 indicates a subtraction point for the latest load value in steady operation. The shift register, with its control means, is identified by block 18, and the most recent load value at a particular time occupies the shift register location Z1 in block 19.

In block 20, a summation of the respective load values takes place. The subsequent division in order to arrive at the average value is performed in block 21. Since the deviation of the respectively latest value from the average value is also processed, a corresponding computation is provided in block 22.

Range classification is the task of the next interrogation unit 23. Two interrogation units 24 and 25 follow, with which slow load reductions and slow load increases, as shown in FIGS. 2*c* and 2*e* are detected respectively. As long as the thresholds shown in FIGS. 2*c* and 2*e* have not yet occurred, the most recent basic injection quantity value at a particular time corresponds to the averaged load signal. If this is not the case, then a progressive approximation of the respective load value is effected via block 26 in accordance with the formula $$ti_{new}=tiM+\Delta tiM/2.$$

This also applies to the case where a special range has been recognized via the range recognition circuit 23 and the variation in this special range exceeds a specified threshold value (block 27). If the new basic injection value is the averaged value (block 28), then the consecutive number Z is continuously increased by 1 (block 30) until a final value N has been attained, and the process jumps back to the outset point A. If, however, a signal is generated which deviates from the average signal, then a new averaging process is performed, and a new entry of values is made into the shift register, in accordance with data in a block 29. Here, again, there is a subsequent jump of the entire course of computation back to the outset point A.

With the aid of the program course shown in FIG. 3, various threshold values for the basic injection signal are accordingly generated and interrogated, each coming into effect in accordance with the cases illustrated in FIG. 2. What is essential is the continuous averaging process during steady engine operation as well as the mode of operation in the respective transitional ranges such as acceleration and overrunning. With a view to the best possible acceleration, the driver's intention is given immediate priority, while in the case of overrunning a flatter downward slope may be selected, in order to attain a gentle transition. Furthermore, slow acceleration processes and load reductions are recognized, and an appropriate signal processing is performed.

As a whole, there are four different possibilities for the new basic injection value:

$ti_{new}$=ti(K) for instances of acceleration and, as needed, for overrunning;

$ti_{new}=ti(k-1)+\Delta ti/2$ for a gentle transition to overrunning;

$ti_{new}$=tiM as the averaged value in the case of steady driving operation; and $ti_{new}=tiM+\Delta tiM/2$ for the sake of successive approximation of the average value signal to the load signal in the case of slow acceleration processes and load reductions having a relatively flat course.

Figure 4:
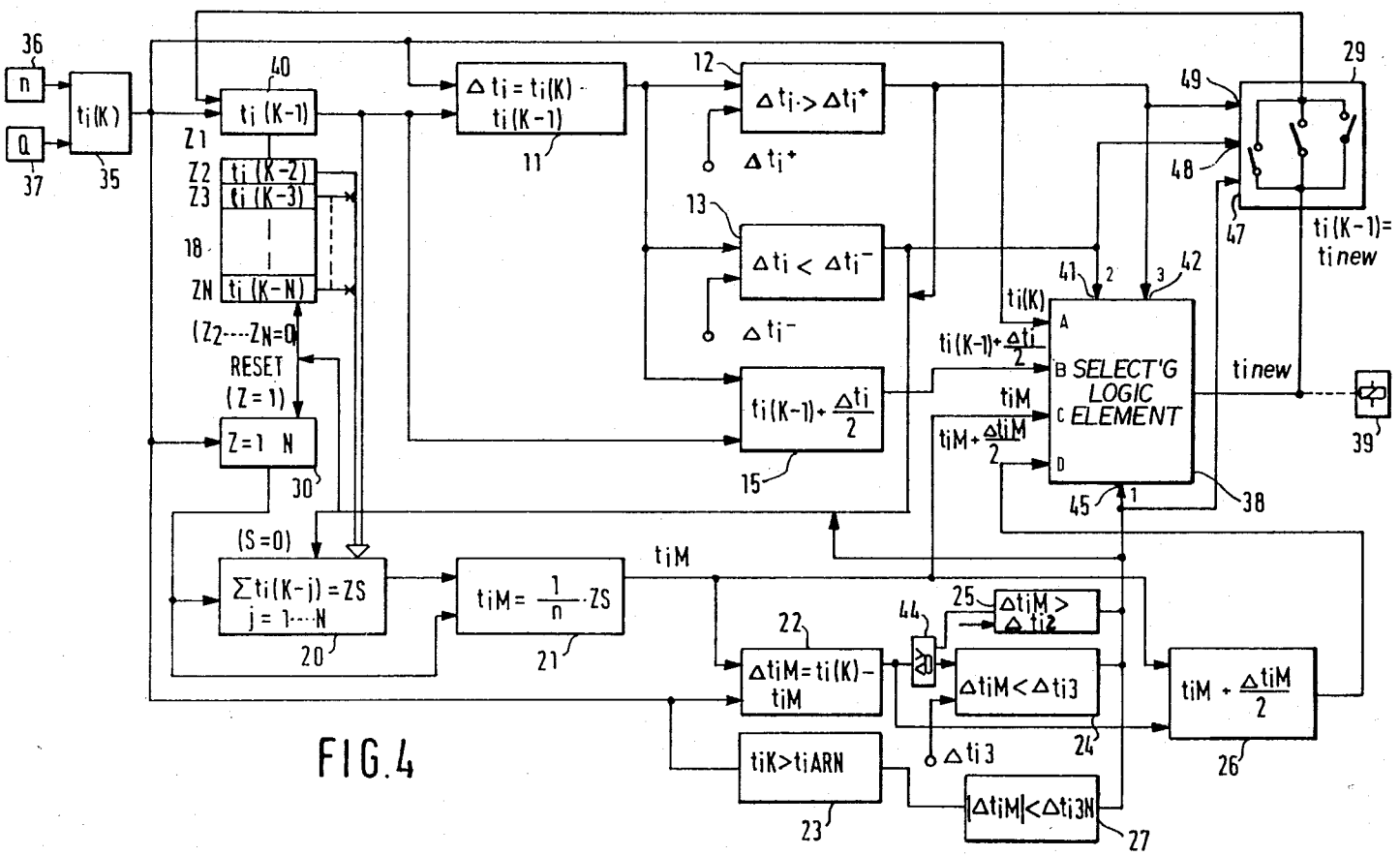
FIG. 4 is a block circuit diagram as one example of a hardware means of attaining the object of the invention.

One example of a possibility for realizing the invention in terms of hardware is shown in FIG. 4. For the sake of clarity, the individual blocks of FIG. 4 are provided with the reference numerals already familiar from FIG. 3 whenever such reference numerals are applicable; however, in principle, the blocks in the flow diagram solely represent computer operations, while those of FIG. 4 represent circuit layouts for realizing the specialized functioning.

In order to fully realize the circuit layout of FIG. 4 in terms of a fuel metering system, there is also a timing element 35 for generating the quotient of the air throughput and rpm based on signals from an rpm transducer 36 and an air flow rate meter 37. There is also a selecting logic element 38 for switching-through of desired individual variables in accordance with the various individual driving states, and finally the valve winding of an injection valve 39 is shown. As a rule, there are also correction circuits at least for temperature and battery voltage located in the signal line leading to this injection valve.

The details of the layout are as follows: The output of the timing element 35, at which the respectively most recent ti(k) value is found, is necessarily coupled with all the circuits which process or pass along the up-to-date basic injection value or load value. These circuits are the selection logic 38, the differentiation circuit 11 for sequential load signals, a memory circuit 40 for the immediately previous load signal, a counter 30 which furnishes control signals for an adding member 20 and for the divider circuit 21, and furthermore a subtraction circuit 22 for forming the difference between the up-to-date load value and the up-to-date average value, as well as a threshold circuit 23 for interrogating the range.

On the output side, the subtraction circuit 11 is coupled with two comparators 12 and 13 for recognizing acceleration and transition into overrunning; their output signals, in turn, can be switched to two control inputs 41 and 42 of the selection logic 38. These comparators 12 and 13 also furnish reset signals for the adding circuit 20. This is because the averaging process, in the specialized example shown in FIG. 4, is stopped when one of these transitional operating states occurs and corresponding addition values should then be erased. The same reset signal is also received by the shift register 18 and the counter 30. The counter state of the counter 30 at any particular time controls the adding circuit 20, the continuing progression of the contents of the shift register 18 and the divider circuit 21. The output signal of this divider circuit 21 is an average value for the basic injection time tiM, which serves in turn as an input variable for the subraction circuit 22, the division-and-adding circuit 26 and for the selection logic 38.

A further division-and-adding circuit 15 furnishes a $ti(k-1)+\Delta ti/2$ signal for a further input of the selection logic 38. The difference between the up-to-date load value and the momentary average value is provided by the subtraction circuit 22, which in turn passes its output signal on to the division-and-adding circuit 26 as well as to an algebraic sign [+ or −] recognition circuit 42.

This is followed by two threshold switches 24 and 25 for interrogation of thresholds relating to slow acceleration processes and load reductions of a relatively flat course. A further control input 45 of the selection logic 38 receives output signals from the threshold switches 24, 25 and 27, whose output signals also cause the resetting of the adding member 20 and of the counter 30. The control circuit 29 assures that, in accordance with input signals at its three inputs 47, 48, 49, the most recent respective load $ti_{new}$ is entered as the most recent value in the memory 40 for the immediately previous load value. The input 47 (see FIG. 4) is connected with the control input 45 of the selection logic 38, input 48 is connected with control input 41, and finally input 49 is connected with the control input 42. The control apparatus 29 can be realized by means of a threefold OR gate for the individual input variables.

Figure 5:
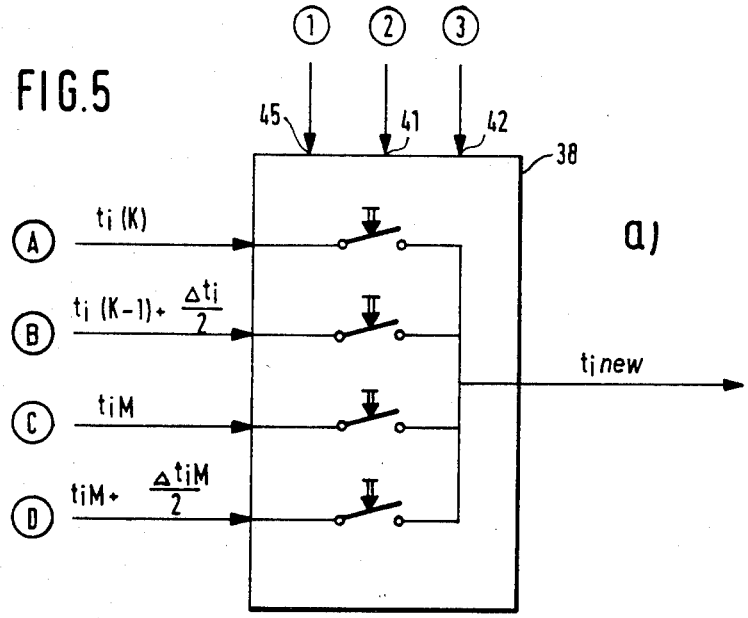
FIGS. 5*a* and 5*b* show a detail of the subject of FIG. 4.

Care must be taken in the selection logic 38 such that, depending on operational state, the individual computed variables are switched through to the output as respectively new basic injection quantity values. The required logical linkage is shown in FIG. 5. In FIG. 5, the selection logic 38 is again shown schematically, with the individual data and value inputs; FIG. 5*b* gives a logic table according to which the individual switches seen in FIG. 5*a* are to be closed. The first line of the table in FIG. 5*b* represents the case of acceleration; the second line shows the emission of signals during transition into overrunning; and lines 3 and 4 characterize various cases of more or less steady operation. In line 3, the curve courses indicated by broken lines in FIGS. 2*c* and 2*e* for the output signal are replicated.

Independently of the particular realization selected, whether computer-controlled or having a circuit layout made up of discrete modular elements, the fuel metering system described above excels in enabling very good driving operation in all possible operational ranges and at all operational states which may arise.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electronically controlled fuel metering system for an internal combustion engine having a metering signal generating circuit for forming a basic metering signal comprising:

means for generating an output signal $ti_{new}$, said output signal generating means forming at least two of the following signals in dependence upon engine conditions: (1) an up-to-date load signal ti(K); (2) an average value load signal ti(M); (3) a signal indicating engine overrun during slow load reduction according to $ti(K-1)+\Delta ti/2$; and (4) form an approximate load signal according to $tiM=\Delta tiM/2$, wherein ti=load signal, K=present value and M=average value, means selecting one of the above signals as said output signal, and wherein said generated output signal $ti_{new}$ controls fuel metering in accordance with at least one of ti(K) and tiM.

2. A method for electronically controlled fuel metering system for an internal combustion engine having a metering signal generating circuit for forming a basic metering signal comprising the steps of generating an output signal, $ti_{new}$;

said generating circuit forming at least two of the following signals in dependence upon engine conditions:

(1) an up-to-date load signal according to ti(K), (2) an average value engine load signal according to ti(M), (3) a signal indicating engine overrun during slow load reduction according to $ti(K-1)+ti/2$, (4) an approximate load signal according to tiM+-tiM/2, wherein ti=load signal, K=present value and M=average value, selecting one of the above signals as said output signal, and controlling fuel metering with said generated output signal $ti_{new}$ in accordance with at least one of ti(K) and tiM.

3. An electronically controlled fuel metering system for an internal combustion engine having a metering signal generating circuit for forming a basic metering signal, the fuel metering system including:

a first means connected to the engine for generating an up-to-date engine load signal according to ti(K);

a second means connected to the engine for calculating and generating an average engine load signal according to ti(M);

a third means connected to the engine for detecting and generating a signal indicating engine overrun during slow load reduction according to $ti(K-1)+\Delta ti/2$;

a fourth means connected to the engine for calculating and generating an approximate load signal according to $tiM+\Delta tiM/2$;

wherein ti=load signal, K=present value, and M=average value; and wherein the fuel metering system further includes a logic means connected to at least the first means and the second means, to generate an output signal $ti_{new}$ to control fuel metering in accordance with at least one of ti(K) and ti(M).

4. An electronically controlled fuel metering system as defined in claim 3, wherein operation of the second means for forming the average value load signal is responsive to a means for detecting at least one of engine acceleration and engine overrun.

5. An electronically controlled fuel metering system as defined by claim 3, further including:

a deviation means connected to the first means and the second means which determines the difference between the up-to-date engine load signal and the average engine load signal and generates an output indicative thereof;

a comparison means connected to receive the deviation means output and to compare the deviation means output to a predetermined value, and is also connected to the fourth means to trigger the approximate load signal if the deviation means output exceeds the predetermined value.

6. An electronically controlled fuel metering system as defined in claim 5, further including:

a sensing means connected to the engine to detect rpm and load range and connected to the second means and the fourth means to respectively affect the average engine load signal and the approximate load signal according to rpm and load range.

7. An electronically controlled fuel metering system as defined in claim 3, further including:

a storage means connected to the first means, which sequentially receives and stores sequential up-to-date engine load signals, and is connected to the second means which receives the stored sequential up-to-date engine load signals for calculating ti(M).

8. An electronically controlled fuel metering system as defined in claim 7, wherein the storage means stores a maximum of eight sequential up-to-date engine load signals.

* * * * *